US008083069B2

(12) United States Patent
Murthy et al.

(10) Patent No.: US 8,083,069 B2
(45) Date of Patent: Dec. 27, 2011

(54) HIGH THROUGHPUT MAGNETIC ISOLATION TECHNIQUE AND DEVICE FOR BIOLOGICAL MATERIALS

(75) Inventors: Sunil Srinivasa Murthy, Bangalore (IN); Aaron Joseph Dulgar-Tulloch, Ballston Spa, NY (US); James William Bray, Niskayuna, NY (US); Shankar Chandrasekaran, Chennai (IN); Arvind Kumar Tiwari, Bangalore (IN)

(73) Assignee: General Electric Company, Niskayuna, NY (US)

( * ) Notice: Subject to any disclaimer, the term of this patent is extended or adjusted under 35 U.S.C. 154(b) by 90 days.

(21) Appl. No.: 12/533,180

(22) Filed: Jul. 31, 2009

(65) Prior Publication Data

US 2011/0024331 A1 Feb. 3, 2011

(51) Int. Cl.
*B03C 1/00* (2006.01)
*B07C 5/02* (2006.01)

(52) U.S. Cl. ..... 209/8; 209/158; 209/214; 209/232; 210/222

(58) Field of Classification Search ..... 209/3.3, 209/8, 155, 158, 214, 232; 210/222, 223, 210/695

See application file for complete search history.

(56) References Cited

U.S. PATENT DOCUMENTS 3,463,319 A 8/1969 Moragne
3,970,518 A 7/1976 Giaever
4,375,407 A * 3/1983 Kronick ..... 435/29
4,769,130 A 9/1988 Christensen
4,816,143 A 3/1989 Vollmar
4,913,883 A 4/1990 Imai et al.
4,941,969 A 7/1990 Schonert et al.
5,411,863 A * 5/1995 Miltenyi ..... 435/6
5,458,785 A 10/1995 Howe et al.
5,514,340 A 5/1996 Lansdorp et al.
5,543,289 A 8/1996 Miltenyi
5,693,539 A * 12/1997 Miltenyi et al. ..... 436/526
5,976,369 A 11/1999 Howe et al.
5,981,297 A 11/1999 Baselt
6,013,188 A * 1/2000 Terstappen et al. ..... 210/695

(Continued)

FOREIGN PATENT DOCUMENTS

DE 3827252 A1 * 2/1990

(Continued)

OTHER PUBLICATIONS

Adams, J. D., et al., "Multitarget magnetic activated cell sorter", Proc. National Academy of Sciences, 2008, 105:18165-18170.

(Continued)

*Primary Examiner* — Joseph C Rodriguez
(74) *Attorney, Agent, or Firm* — Jenifer E. Haeckl

(57) ABSTRACT

The present application discloses a process for the high throughput separation of at least one distinct biological material from a sample using magnetic tags and a magnetic separation set up capable of processing at least about $10^6$ units/second. A magnetic field gradient is used to deflect target material bearing a magnet tag from one laminar flow stream to another so that the magnetically tagged target material exits a separation chamber via a different outlet than the rest of the sample. The process is applicable to isolating several distinct biological materials by directing each via magnetic deflection to its own unique outlet. The application also discloses a system for performing the process and a kit that includes the system and the magnetic tags.

29 Claims, 3 Drawing Sheets

U.S. PATENT DOCUMENTS

| | | | | |
|---|---|---|---|---|
| 6,020,210 | A * | 2/2000 | Miltenyi | 436/526 |
| 6,120,735 | A * | 9/2000 | Zborowski et al. | 422/73 |
| 6,126,835 | A * | 10/2000 | Barbera-Guillem et al. | 210/695 |
| 6,241,894 | B1 | 6/2001 | Briggs et al. | |
| 6,297,061 | B1 | 10/2001 | Wu et al. | |
| 6,337,215 | B1 | 1/2002 | Wilson | |
| 6,413,420 | B1 | 7/2002 | Foy et al. | |
| 6,417,011 | B1 * | 7/2002 | Miltenyi | 436/526 |
| 6,432,630 | B1 | 8/2002 | Blankenstein | |
| 6,437,563 | B1 | 8/2002 | Simmonds et al. | |
| 6,597,176 | B2 | 7/2003 | Simmonds et al. | |
| 6,657,713 | B2 | 12/2003 | Hansen | |
| 6,713,299 | B1 * | 3/2004 | Sengoku | 435/288.6 |
| 6,849,186 | B2 | 2/2005 | Johnson et al. | |
| 6,929,750 | B2 * | 8/2005 | Laurell et al. | 210/708 |
| 7,179,391 | B2 * | 2/2007 | Leach et al. | 210/782 |
| 7,226,537 | B2 | 6/2007 | Broyer et al. | |
| 7,232,691 | B2 | 6/2007 | Kraus et al. | |
| 7,332,352 | B2 | 2/2008 | Reeve | |
| 7,360,657 | B2 | 4/2008 | Oder et al. | |
| 2002/0000398 | A1 * | 1/2002 | Skold | 209/214 |
| 2002/0074266 | A1 | 6/2002 | Franzreb et al. | |
| 2002/0137226 | A1 | 9/2002 | Tanaami | |
| 2002/0146848 | A1 | 10/2002 | Reeve | |
| 2002/0162798 | A1 | 11/2002 | Johnson et al. | |
| 2002/0166800 | A1 | 11/2002 | Prentiss et al. | |
| 2003/0052426 | A1 | 3/2003 | Andersson et al. | |
| 2003/0186465 | A1 | 10/2003 | Kraus et al. | |
| 2004/0065593 | A1 | 4/2004 | Duo | |
| 2004/0108253 | A1 | 6/2004 | Broyer et al. | |
| 2004/0219066 | A1 | 11/2004 | Kraus et al. | |
| 2004/0235196 | A1 | 11/2004 | Colin | |
| 2005/0013741 | A1 | 1/2005 | a'Brassard | |
| 2005/0035030 | A1 | 2/2005 | Oder et al. | |
| 2005/0110176 | A1 | 5/2005 | Andersson et al. | |
| 2005/0274650 | A1 * | 12/2005 | Frazier et al. | 209/39 |
| 2008/0124779 | A1 | 5/2008 | Oh et al. | |
| 2008/0152939 | A1 | 6/2008 | Alterman et al. | |
| 2008/0283792 | A1 | 11/2008 | Axen et al. | |
| 2009/0044619 | A1 * | 2/2009 | Fiering et al. | 73/202 |
| 2009/0047297 | A1 * | 2/2009 | Kim et al. | 424/184.1 |
| 2009/0078614 | A1 * | 3/2009 | Varghese et al. | 209/39 |
| 2009/0092837 | A1 | 4/2009 | Axen et al. | |
| 2009/0139908 | A1 * | 6/2009 | Zhou et al. | 209/225 |
| 2009/0197329 | A1 * | 8/2009 | Lee et al. | 435/325 |
| 2009/0220932 | A1 * | 9/2009 | Ingber et al. | 435/2 |

FOREIGN PATENT DOCUMENTS

| | | | |
|---|---|---|---|
| WO | 9112079 | A1 | 8/1991 |
| WO | WO9111716 | * | 8/1991 |
| WO | 2008127292 | A2 | 10/2008 |

OTHER PUBLICATIONS

Busch, et al., "Enrichment of Fetal Cells From Maternal Blood by High Gradient Magnetic Cell Sorting (Double Macs) For PCR-Based Genetic Analysis", Prenatal Diagn, 1994; 14:1129-1140.

de Wynter, E. W., et al., "Comparison of Purity and Enrichment of CD34' Cells from Bone Marrow, Umbilical Cord and Peripheral Blood (Primed for Apheresis) Using Five Separation Systems", Stem Cells, 1995, 13:524-532.

Fuh, C. B., et al., "Development of magnetic split-flow thin fractionation for continuous particle separation", Anal. Chim Acta, 2003, 497:115-122.

Giddings, J.C., "Field-Flow Fractionation: Analysis of Macromolecular, Colloidal, and Particulate Materials", Science, vol. 260, 1993, pp. 1456-1465.

Gupta, A.K., et al., "Receptor-Mediated Targeting of Magnetic Nanoparticles Using Insulin as a Surface Ligand to Prevent Endocytosis", IEEE Trans. on Nanobioscience, 2003, 2:255-261.

Gupta, P.K. et al., "Magnetically Controlled Targeted Micro-Carrier Systems", Life Sci., 1989, 44:175-186.

Handgretinger, et al., "Biology and Plasticity of CD 133 Hematopoietic Stem Cells", Annals of New York Academy of Sc., 2003, 996:141-151.

Hansel, T.T., et al., "An improved immunomagnetic procedure for the isolation of highly purified human blood eosinophils", J Immunol Methods, 1991, 145:105-110.

Happel, J. et al., "Low Reynolds Number Hydrodynamics", Prentice Hall Inc. Publisher, Englewood Cliffs, NJ, US, pp. 273-285 (1965).

Hartig, R., et al., "Preparative continuous separation of biological particles by means of free-flow magnetophoresis in a free-flow electrophoresis chamber", Electrophoresis, 1992, 13:674-676.

Kato, K. et al., "Isolation and Characterization of CD34 + Hematopoietic Stem Cells From Human Peripheral Blood by High-Gradient Magnetic Cell Sorting", Cytometry, 1993, 14:384-392.

Krishnamurthy, H., et al., "Quantification of Apoptotic Testicular Germ Cells in Normal and Methoxyacetic Acid-Treated Mice as Determined by Flow Cytometry", J Androl, 1998, 19:710-717.

Leary, J.F., "Ultra High-Speed Sorting", Cytometry A, 2005, 67A:76-85.

Pamme, N. et al., "Continous sorting of magnetic cells via on-chip free-flow magnetophoresis", Lab Chip, 2006, 6:974-980.

Powles, R., et al., "Allogeneic blood and bone-marrow stem-cell transplantation in haematological malignant diseases: a randomised trial", Lancet, 2000, 355:1231-1237.

Schmitz, B., et al., "Magnetic activated cell sorting (MACS)—a new imrnunomagnetic method for megakaryocytic cell isolation: Comparison of different separation techniques", Eur J Haematol 1994; 52:267-275.

Schmitz, J., et al., "Optimizing follicular dendritic cell isolation by discontinuous gradient centrifugation and use of the magnetic cell sorter (MACS)", Journal of Immunological Methods, 159 (1993) 189-196.

Seidl, J., et al., "Evaluation of Membrane Physiology Following Fluorescence Activated or Magnetic Cell Separation", Cytometry, 1999, 36:102-111.

Semple, J.W., et al., "Rapid Separation of CD4 + and CD19 + Lymphocyte Populations From Human Peripheral Blood by a Magnetic Activated Cell Sorter (MACS)", Cytometry 1993, 14:955-960.

Takayasu, M., et al., "Continuous Magnetic Separation of Blood Components from Whole Blood", IEEE Trans. Appl. Superconductivity, 2000, 10:927-930.

Weissman, I. L., "Translating Stem and Progenitor Cell Biology to the Clinic: Barriers and Opportunities", Science, 2000, 287:1442-1446.

Zborowski, M., et al.,"Continuous cell separation using novel magnetic quadrupole flow sorter", J. Magn. Magn. Mater., 1999, 194:224-230.

Zborowski, M, et al., "Red Blood Cell Magnetophoresis", Biophysical J., 2003, 84:2638-2645.

Zborowski, M., et al., "Magnetic Cell Sorting Immunochemical Protocols", 2005, 295:291-300.

* cited by examiner

HIGH THROUGHPUT MAGNETIC ISOLATION TECHNIQUE AND DEVICE FOR BIOLOGICAL MATERIALS

BACKGROUND

The subject matter disclosed herein relates generally to the high throughput isolation of biological materials. Recent developments in the life sciences including cell therapy and diagnostic techniques based on the prevalence of biomolecules and cells in a sample have made it increasingly more important to be able to rapidly and efficiently isolate these materials from a sample without unduly compromising the integrity of these materials. Such materials have been isolated using either non-immunological or immunological means. The former approach has relied upon physical properties of the materials such as size, shape, density and charge. While this approach has yielded fast and simple isolation techniques they have lacked the desired specificity, especially in the case of cells. The latter approach, which involves attaching some sort of label to the biological material using specific recognition factors like antibodies, receptors or receptor ligands, may provide a high degree of specificity but to date has not provided the desired throughputs with minimal damage to the materials being isolated. Fluorescent Activated Cell Sorting (FACS), a specialized type of flow cytometry, is able to isolate biological materials with minimal damage but it is limited in its throughput capacity. For instance, the typical bone marrow aspirate, which is a likely target of such separations, is about 1.5 L containing about $15\times10^6$ nucleated cells/ml so that about $2.25\times10^{10}$ nucleated cells need to be processed and the typical umbilical cord sample is about 100 ml containing about $5\times10^6$ nucleated cells/ml so that about $5\times10^8$ nucleated cells/ml need to be processed. But FACS has a typical processing capacity of only about $50\times10^3$ cells/second. Its use in such cell separations would lead to inordinately long separation times. To obtain practical separation times a sorting capacity of at least about $10^6$ cells/second is desirable. On the other hand, Magnetic Activated Cell Sorting (MACS) has a fairly high capacity but its batch procedure may result in damage to the material being separated. In addition its batch procedure is labor intensive, not readily automated and in practice limited to binary sorting in which only a single target may be extracted from a sample.

Thus there is a need for a high throughput technique of isolating a biological material with minimal damage to the material being isolated that has high specificity and a sorting capacity of at least about $10^6$ units/second. Such an approach should combine the high specificity of labeling the biological material using a recognition factor to attach the label with high capacity isolation with minimal damage.

BRIEF DESCRIPTION

The present invention involves a process for the high throughput separation of at least one distinct biological material from a sample. It is readily applicable to samples containing several distinct biological materials of the same type, for instance living cells of distinct types, using magnetic tags and a magnetic separation set up capable of processing at least about $10^6$ units/second preferably at least about $10^7$ units/second with a reasonable degree of purity in the separated material. The process involves associating said biological material with particles with a particular magnetic responsiveness and subjecting the particles to laminar flow in a fluid medium through a separation chamber. The separation chamber has at least one inlet and multiple outlets with at least one outlet positioned such that the laminar flow would cause particles entering a given inlet to exit that outlet in the absence of any other force and at least one outlet that is not in the line of laminar flow from that inlet. A magnetic field gradient is applied to the chamber during this laminar flow to deflect particles with a particular magnetic responsiveness to an outlet that they would not reach as a result of the laminar flow.

The parameters of the process are selected such that at least about $10^6$ units, preferably $10^7$ units of biological material/second are processed. The magnetic field gradient, the magnetic responsiveness of the particles and the deflection necessary to direct said particles to the appropriate outlet tend to define the minimum residence time for particles in the separation zone of the separation chamber. The length of the separation chamber in the direction of laminar flow and the fluid flow rate through the chamber can then be selected to provide an adequate residence time. The concentration in the sample stream being injected into the separation chamber of the biological material being subjected to separation and the flow rate of this stream into the separation chamber is selected such that at least about $10^6$ units, preferably $10^7$ units, of biological material are passed through the chamber per second. Of course, the process parameters and chamber design should be selected to provide residence times that accommodate this throughput. Thus, for instance, the magnetic field gradient should be selected such that the minimum residence time for particles in the separation zone of the separation chamber is compatible with this throughput.

A given unit of a biological material, for instance a cell or a biomolecule, is associated with one or more particles with a given magnetic responsiveness or a particle with a given magnetic responsiveness is associated with several units of a given biological material. However, it may be important that the ratio between units of a given biological material and the particles with a particular magnetic responsiveness be fixed in order that each unit be subjected to the same deflection in passing through the separation chamber. If the units of a given biological material may be permitted to have a range of deflections then the ratio of particles to units of the given biological material may be selected to achieve that range of deflection.

The association of the particles with the given biological material is achieved by methods known in the art to create specific associations. One typical approach is to attach an antibody specific to a given biological material to a particle with a given magnetic responsiveness and then mix such magnetically tagged antibodies with the sample to be subjected to separation.

In a particular embodiment the separation process may be used to isolate more than one biological material. In such a case each biological material to be isolated needs to be imparted with its own magnetic responsiveness so that it can be deflected to one or more outlets specifically assigned to that biological material. This can readily be accomplished by selecting multiple classes of particles, each with its own distinct magnetic responsiveness, and binding each class to a reactant specific to one of the target biological materials. In such a process one or more outlets should be assigned to each target biological material to be separated and the magnetic field gradient should be applied such that each target biological material is deflected to its assigned outlets.

The magnetic field gradient is selected such that it can achieve the needed deflection of the particles with a given magnetic responsiveness during the particles' residence time in the separation zone of the separation chamber. This in turn is dependent upon the deflection distances to the outlets to which such particles are to be directed and the magnetic responsiveness of the particles. In this regard, the force on such particles is the vector product of the magnetic field and their magnetic moments. Thus particles with a greater magnetic moment require a lesser field to be subjected to the same force.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
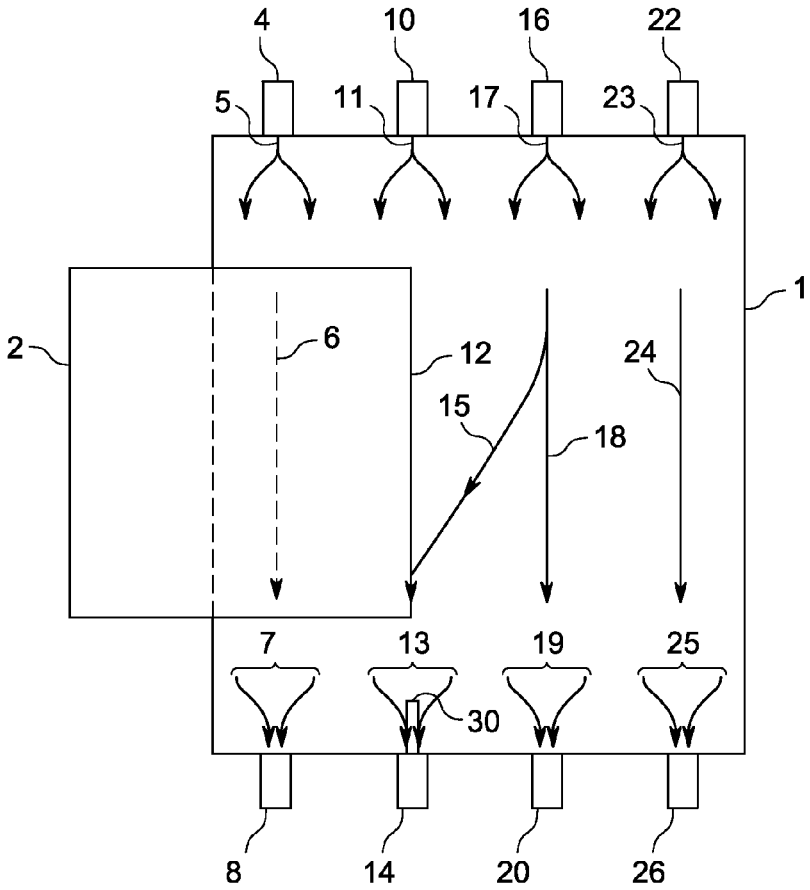
FIG. 1 is a schematic of a separation chamber supporting laminar flow between four inlets and opposite outlets and a superimposed magnet applying a magnetic field gradient to cause deflection of magnetically responsive particles.

The process of the present invention is a technique of isolating one or more target biological materials from a sample containing multiple distinct biological materials of the same type with a sufficiently high throughput to be clinically useful in a wide variety of applications such as isolating stem cells from bone aspirate or umbilical cord blood. It involves tagging the biological material to be isolated with magnetically responsive particles, subjecting the tagged particles to laminar flow through a separation chamber having multiple outlets and applying a magnetic field gradient to the separation chamber to deflect the tagged material to an outlet other than one in a direct line with the laminar flow. The process is operated so that at least about $10^6$ units, preferably $10^7$ units, of biological material of the given type per second are processed.

The process conveniently provides for the separation of one or more biological materials from similar but distinct biological materials. For instance, the process can be advantageously applied to separating one or more types of cells from a much larger population of cells. In order to obtain separations in a reasonable time it may be necessary to process a large amount of all the biological materials of a given type present in a given sample, including both those sought and those not desired, in a short time period. For instance, the typical bone aspirate sample used for the isolation of stem cells is 1.5 L and contains $2.25\times10^{10}$ nucleated cells although only between about 0.01% and 0.1% of these cells are mesenchymal stem cells (MSC). Thus the separation process would need to process the entire $2.25\times10^{10}$ nucleated cells even though only a small proportion of them, between about $10^6$ and $10^7$, will be magnetically tagged and separated. In contrast, if the sample were adipose tissue the MSC content would be between about 1% and 10% and if the sample were umbilical cord blood and the target were T-cells the recovery could be as much as 10% and if the target were granulocytes the recovery could be as much as 60%. Therefore the number of sample units the process acts upon may be substantially greater than the units of target material isolated.

The process can be applied to any biological material whose units can be tagged with magnetically responsive particles and then subjected to laminar flow in a carrier medium. This, of course, means that the material must be accessible to a tagging reaction and also able to flow as individual units in a fluid medium. For instance, if the target biological material were contained in a cell it would probably be necessary to lyse the cell to release the material. The process may be conveniently applied to biomolecules such as proteins and to cells themselves. In one embodiment the process is applied to living cells that display a surface marker that can be used as a means of associating the cells with magnetically responsive particles.

The magnetically responsive particles can be any particles of an appropriate size for association with target biological materials and for participation in laminar flow and must be responsive to a magnetic field gradient. The particles may be small enough that several can associate with a single unit of a target biological material or large enough that several units of the biological material may associate with it. In some embodiments it is important to control the ratio of magnetically responsive particle to units of target biological material such that the deflection of these units in a given magnetic field gradient is within a given range while in another embodiment it is simply sufficient that the units of the targeted biological material undergo some minimum deflection. The particles may conveniently have a particle size between about 50 nanometers and 1000 microns. Suitable particles with a size range between about 1 and 10 microns are commercially available. Particles between about 1 and 20 nanometers such as 16 nm Super-Paramagnetic Iron Oxide (SPIO) particles are also suitable.

It is convenient to use larger particles because they tend to be easier to deflect. The magnetic force on a particle is generally dependent on its volume but the drag on the particles from the fluid medium when they move laterally in response to the magnetic field gradient is dependent upon their surface area so there may be an advantage in having less surface area per unit volume.

The magnetic characteristics of the magnetically responsive particles can range from having permanent magnetic moments to having inducible magnetic moments. The latter are more convenient because once the deflection is achieved and the particles pass out of the magnetic field they do not have a retained magnetic property that might cause agglomeration. It is convenient if the magnetically tagged target biological materials have magnetic moments as determined by a magnetic sweep between 0.2 and 0.6 T greater than about $10^{-14}$ A.m$^2$ with moments between about $5\times10^{-14}$ and $100\times10^{-14}$ being particularly convenient. These moments can be obtained by associating one or more units of target biological material with a magnetic bead displaying such a moment under the specified test conditions or by associating one unit of target biological material with multiple magnetic beads whose total moment under these conditions falls within the desired range. Magnetic beads based on SIPO particles are particularly convenient such as polymer particles with embedded SIPO particles. Many such polymer particles are commercially available and among these those evaluated include Dynal 2.8 micron particles with a moment range for the sweep of 10 to $12.\times10^{-14}$ A.m$^2$, Micromod 3.0 micron particles with a moment range for the sweep of 9.0 to $10\times10^{-14}$ A.m$^2$ and Micromod 4.0 micron particles with a moment range for the sweep of 18 to $21\times10^{-14}$ A.m$^2$.

The magnetically responsive particles may be associated with the units of the target biological material in any convenient manner which allows specific attachment to just the target biological material and results in a strong enough association to survive laminar flow and deflection in the separation chamber. Immunological interactions and ligand receptor interactions are convenient for this purpose. In the former case antibodies to the target biological material may be attached to the magnetically responsive particles while in the latter case a ligand to a receptor carried by the target biological material may be attached to the magnetically responsive particles. Of course, if the target biological material is an antibody or a receptor ligand the attachment approach can be reversed. In any case the moiety used to associate the magnetically responsive particles with the target biological material may be directly or indirectly attached to the magnetically responsive particles. One suitable approach is to use magnetically responsive particles that are coated with a member of a common binding pair such as biotin or streptavadin and antibodies or receptor ligands that are bound to the other member of the pair.

The sample containing the target biological material is injected into an inlet of the separation chamber in which laminar flow of a carrier fluid is being maintained. The fluid flow rate at which this injection stream enters the separation chamber is important to the processing capacity of the process. The higher the fluid flow rate the greater the amount of biological material that can be processed per unit time. Flow rates of greater than about 1 ml/min are convenient while rates between about 2 ml/min and 5 ml/min are particularly convenient.

The concentration in the injection stream of the biological materials to be subject to the separation process is conveniently as high as possible without compromising the separation process. The higher the concentration of materials to be separated the more readily the throughput needed to obtain reasonable processing time is obtained. However, as the concentration of materials being subjected to magnetic deflection increases so does the probability of hydrodynamic effects that would cause the deflected material to entrain non-target biological material in its lateral motion. In addition, at higher concentrations the deflection could cause disturbance to the laminar flow and cause some stirring or mixing. In the case of cell separations total cell concentrations of between about $10^7$ cells/ml and $10^{10}$ cells/ml are convenient with concentrations between about $10^8$ cells/ml and $10^9$ cells/ml being particularly convenient. Similar concentrations are applicable to other types of biological materials such as biomolecules.

In this regard the injected biological material, other than that which is magnetically deflected, tends to remain in the laminar flow path between the inlet into which it is injected and the outlet opposite this inlet at the opposite end of the separation chamber. There is minimal dilution into the rest of the separation chamber. This is particularly the case when this laminar flow path is sandwiched between two laminar flow paths of carrier fluid maintained between inlets on either side of the injection inlet and their respective outlets opposite these inlets at the opposite end of the separation chamber.

As used in this application an outlet is "opposite" an inlet if the inlet and its opposite outlet maintain a laminar flow path between them when carrier fluid laminar flow is initiated in the separation chamber. Thus an inlet and its "opposite" outlet are the upstream entry and downstream exit, respectively, for a laminar flow path. In one embodiment an outlet may lie along a straight line from its opposite inlet but in another embodiment the laminar flow path between them may be curved.

A convenient approach is to place the injection inlet between two carrier fluid inlets so that its laminar flow path is sandwiched between the laminar flow paths maintained between these inlets and their respective outlets opposite these inlets at the opposite end of the separation chamber. The one carrier fluid laminar flow path can serve to isolate the injection stream laminar flow path from any edge effects from a longitudinal edge of the separation chamber while the other carrier fluid laminar flow path can serve as the flow path into which the target biological material is deflected due to its association with magnetically responsive particles. In one embodiment this second carrier fluid laminar flow path is isolated from edge effects by the provision of a third laminar flow path between it and the longitudinal edge of the separation chamber to which it is adjacent by providing an inlet and associated outlet between the inlet maintaining the deflection laminar flow path and this edge.

This approach of isolating the laminar flow paths involved in the separation from edge effects can also be readily applied to effecting multiple simultaneous separations. In this case the laminar flow paths from the sample injection inlet and all the laminar flow paths leading to the outlets for the collection of the multiple target biological materials are designed to be collectively sandwiched between two laminar flow paths which run adjacent to the longitudinal edges of the separation chamber. Thus an inlet outlet pair is provided adjacent to each longitudinal edge to support a laminar flow path which is not involved in the separation process.

It is convenient to have each of the inlets evenly spaced from the other inlets so that each laminar flow path is of approximately the same width as the other laminar flow paths. In such an arrangement the average deflection distance for the target biological material and its associated magnetically responsive particle or particles will be approximately the same as the inlet spacing.

The carrier fluid may be any fluid that will support laminar flow that transports the sample and the magnetically responsive particles in the desired concentrations and at the desired flow rates. It is convenient to minimize the viscosity of the carrier fluid so as to minimize the drag that the magnetically labeled biological material will experience when being deflected. But the fluid must have sufficient viscosity to entrain the sample including both the target biological material and the non-target biological material as well as the magnetically responsive particles in the laminar flow. Water is a convenient and inexpensive carrier fluid with a low viscosity. In some cases it may be convenient to increase the viscosity of water with appropriate thickeners such as sucrose to avoid settling problems, particularly if the separation chamber is fed from a reservoir. If the biological material may be adversely affected by exposure to pure water, the water may be converted into a convenient buffer. For instance, if the target biological material were living cells salt could be added to the aqueous fluid to render it isotonic thus minimizing cell rupture.

The separation chamber should be of a size and design to allow laminar fluid flow at a rate sufficient to process at least about $10^6$ units preferably about $10^7$ units of biological material of a given type per second. The needed fluid flow rate depends the concentration of this biological material in the stream being injected into the separation chamber, the flow rate of the injection stream and the overall volume of the separation chamber. The injection stream tends to be confined to its own laminar flow path so the processing capacity is correlated to the velocity at which a unit volume of this laminar flow path passes through the separation chamber. A typical separation chamber may be a rectangular prism with a length between about 50 mm and 200 mm, preferably between about 80 and 150 mm, a width of between about 20 and 100 mm, preferably between about 30 and 65 mm and a height between about 1 mm and 5 mm, preferably about 2 mm. In this regard, it is convenient if the magnetic field gradient at any given point in the width of the separation chamber over a substantial portion of its length is fairly uniform and this is more readily achieved if the height of the chamber is fairly minimal.

In one embodiment the separation chamber is designed to support several parallel laminar flow paths. Typically a number of inlets are provided along the upstream edge of the chamber and an outlet is provided opposite each inlet along the downstream edge of the chamber. Then flow of a carrier fluid can be initiated between each inlet and its opposed outlet. The sample to be subject to separation can then be introduced into one of the inlets. The deflection necessary to cause a magnetically tagged target biological material to exit an outlet adjacent to the one opposite the inlet it entered through is then the distance to the fluidic boundary between the adjacent parallel laminar flow paths. For each individual unit this distance will vary depending on its location in its laminar flow path but for optimum separation magnetically tagged target biological material at the distal fluidics boundary will need to be deflected across the entire laminar flow path into which it was introduced. Because each laminar flow path will be centered about its inlet this means that for evenly spaced inlets this deflection distance for optimum separation will be approximately equal to the distance between the inlets. However, in the typical arrangement each unit will be deflected the same lateral distance because its magnetic tag will have the same magnetic responsiveness as all the other magnetic tags and it will see a similar magnetic field gradient.

A further convenient feature of a separation chamber with multiple laminar flow paths is to have the laminar flow paths involved in the separation surrounded by uninvolved laminar flow paths. For instance in a separation chamber with four inlets with four matched outlets the two central outlets can be used for the separation while the outer two can just support laminar flow paths which isolate the inner laminar flow paths from edge effects from the edges of the chamber. In such an arrangement the sample containing the magnetically tagged target biological material would enter the separation chamber through one of the inner inlets and the magnetically tagged target biological material would be deflected into the laminar flow path originating from the other inner inlet.

FIG. 1 is a schematic illustration of such a separation chamber with the laminar flow paths actively involved in the separation being sandwiched between two other laminar flow paths. A separation chamber 1 has been inserted between the planar poles of a magnet 2 that imposes a magnet field gradient field. Laminar flow of a carrier fluid is maintained by the introduction of carrier fluid at inlets 4, 10, 16 and 22 and its withdrawal from their opposite outlets 8, 14, 20, and 26, respectively. The beginning of the laminar flow path for inlet 4 is shown at 5, the center line at 6 and the end at 7. The laminar flow paths for inlets 10, 16 and 22 are similarly illustrated by 11, 12 and 13; 17, 18 and 19; and 23, 24 and 25, respectively. The deflection path for a magnetically tagged target biological material introduced into outlet 16 is illustrated by 15. As this material is subject to the magnet field gradient imposed by the magnet 6 it is deflected from laminar flow path 18 to laminar flow path 12 and therefore exits through outlet 14 instead of outlet 20. In the absence of such an imposed magnetic force it would exit the separation chamber 1 through outlet 20. Thus laminar flow paths 12 and 18 are actively involved in the separation with 18 being the source and 12 being the destination of the separated material while being sandwiched between laminar flow paths 6 and 24 which are not actively involved in the separation.

The laminar flow in the separation chamber should involve little if any turbulent flow or mixing. The aim is to have sample entering the chamber at an inlet flow across to the outlet opposite the inlet in the direction of the laminar flow in the absence of any magnetic deflection. It is thus advantageous to avoid any other lateral motion that could cause material not subject to magnetic deflection to exit a different outlet. Flow conditions including the chamber design, the fluid velocity, the concentration of the biological materials of a given type and magnetically responsive particles in their laminar flow path and the viscosity of the carrier fluid should conveniently be such that Reynolds numbers less than 2000 are observed.

It is convenient if all of the laminar flow paths in the separation chamber have approximately the same fluid flow rate. This is conveniently achieved by having all the inlets have approximately the same feed rate and having each outlet have the same withdrawal rate as its associated inlet, i.e. the inlet which it is opposite in the sense of this application. In such a case the fluid velocity through the separation chamber will just be the total fluid flow into the chamber divided by the area of the chamber normal to the direction of laminar flow.

The separation chamber should also have a length in the direction of laminar flow to provide an adequate residence time for the units of the biological material being isolated to experience a deflection to an outlet or outlets not in the direct line of the modular flow. In a typical arrangement the chamber is provided with a sample inlet and several outlets with one of the outlets positioned directly opposite from the sample inlet such that sample entrained in the laminar flow of the fluid carrier will, in the absence of any force other than the laminar flow, pass from the inlet to this outlet. One or more other outlets are positioned so that the magnetically tagged target biological material (i.e. the biological material associated with magnetically responsive particles) may be deflected to them by a magnetic field gradient. The separation chamber needs to be long enough that practically imposable magnetic field gradients have sufficient time to cause the needed deflection. Deflection distances of greater than about 5 mm are convenient to get good separation while processing reasonable volumes of the biological material undergoing separation. Deflection distances between about 5 mm and 45 mm are preferred with distance of between about 10 and 30 mm being particularly preferred. Greater deflection distances in this range may be needed if more than one biological material is to be separated. For instance, if two different biological materials were to be separated simultaneously one embodiment would be to assign the first offset outlet to the first material and the next offset outlet to the second material. Thus the second biological material would require a greater deflection to reach its assigned outlet.

The appropriate residence time in the separation region of the separation chamber of the biological material being subjected to separation is dependent on the time needed for deflection of the magnetically tagged biological materials to their assigned outlets. This is turn depends upon the deflection distances from the laminar flow path of the injected sample to the laminar flow paths which lead to the assigned outlets and the magnetic force experienced by the magnetically tagged target biological materials. This then depends upon the magnetic field gradient seen by the magnetically tagged target biological materials over their deflection path and the magnetic responsiveness of this tagged material. This responsiveness may be adjusted by altering the magnetic properties of the tagging particles or the ratio of these particles to the target biological materials. It is usually desirable to minimize the residence time in order to maximize the throughput of the separation process. Another approach, however, is just to extend the length of the separation zone. For any given flow rate of the input stream carrying the material to be separated the residence time in the separation zone can be lengthened by increasing the length of the separation zone. With all this in mind residence times in excess of about 20 seconds are convenient with residence times between about 30 and 300 seconds and preferably between 30 and 150 seconds being particularly convenient.

For the purposes of this application the separation zone of the separation chamber is the portion of the chamber that is subject to a magnetic field gradient effective to cause deflection of magnetically tagged target biological material. For instance if the longitudinal edge of a separation chamber were placed in or adjacent to the air gap of a magnet but the chamber were longer than the air gap in that direction essentially only the portion of the chamber co-extensive with the air gap in that direction would be the separation zone unless some edge effects extended the useful magnetic field gradient a short distance. Thus the residence time in the separation zone is the time available to cause the deflection that affects the separation.

The magnetic field gradient should be imposed on the separation chamber such that it causes the magnetically responsive particles to be deflected some distance out of their laminar flow pattern during the particles' residence time in separation zone of the separation chamber. Typically the magnetic field gradient is imposed at approximately a right angle to the direction of laminar flow. Such an arrangement facilitates maximizing the degree of deflection obtainable from a given magnetic field. A convenient arrangement is to have the magnetic flux decrease as one progresses transversely across the separation chamber. This can be readily achieved by placing one edge of the separation chamber that is parallel to the direction of laminar flow between the poles of an appropriately designed permanent magnet or an electromagnet. The magnetic flux will then decrease as one progresses towards the opposite edge. A convenient magnetic flux gradient in such an arrangement is between about 1 and 20 Tesla per meter (T/m). For a typically sized separation chamber of about 55 mm in width and 2 mm in height a flux density at a pole of greater than about 1 T with the separation chamber centered in an air gap of about 25 mm thus giving a magnetic flux in the portion of the separation chamber between the poles of between about 0.3 T and 0.4 T will yield useful magnetic field gradients.

A convenient approach to ensure that some magnetically labeled target biological materials are not deflected too far is to have the magnetic field gradient end in the laminar flow path that leads to the assigned outlet for these materials. This can be accomplished by inserting the separation chamber into the air gap of the poles of the magnet so that the edge of the poles overlays the laminar flow path leading to the assigned outlet. The materials' deflection will cease when it sees the uniform magnetic field between the poles.

Another approach is simply to adjust the process parameters such that each magnetically labeled target biological material is only deflected so far as to be entrained in the laminar flow path leading to its assigned exit. In other words the residence time and magnetic field gradient should be selected such that the deflection of any given magnetically labeled target biological material is within a range such that it will not overshoot its intended laminar flow path.

The magnetic field gradient can conveniently be given a more favorable distribution across the width of the separation chamber by shaping of the poles of the magnet imposing the magnet flux. If the two poles are simply planar and parallel the gradient will drop sharply as one progresses across the width of the separation chamber from the edge portion inserted between the poles to the opposite edge. This means that there will only be small differences in magnetic flux in adjacent portions near this far edge and consequently it will be more difficult to obtain the desired deflection of magnetically responsive particles in a suitable time, i.e. in a residence time for the particles which fits with the fluid flow requirements. One approach is to design poles that are stepped or open in a V or wedge or curved shape with the mouth pointed to the far edge so that a magnetic field gradient will be created in the air gap of the primary magnet. This means a portion of the separation chamber that is inserted into this air gap can be used for separation instead of seeing the uniform magnetic field that typically exists in the air gap of classic planar poles. Thus the distance over which an effective magnetic gradient is available to obtain deflection and thus separation is increased. In addition some pole shaping will moderate the drop off in magnetic flux in the region extending beyond the air gap thus extending the distance beyond the air gap in which there is still a sufficient magnet field gradient to affect deflection and thus separation. A convenient approach to creating stepped poles is to stack smaller magnets within the air gap of a larger magnet. One approach that was evaluated was modifying an electromagnet with planar 50 mm by 50 mm poles and a 25 mm air gap by stacking 2.5 cm by 2 cm by 0.3 cm NdFeB permanent magnets in its air gap across its width along one edge. On each pole two stacks of 0.6 cm height and 2.5 cm width were laid across one edge and extended 2 cm into the air gap. This created a magnetic field gradient within in the air gap of the electromagnet. If a separation chamber were inserted into this air gap the portion of the camber within this air gap would see a gradient making more of the width of the separation chamber available for separations. The effective separation zone of the separation chamber would no longer be limited to a short length extending from the edge of the poles until the field strength was so low as to no longer provide an effective gradient for deflection. However, any pole shaping which results in creating a useful magnetic field gradient in the air gap of the primary magnet is of value.

Figure 2:
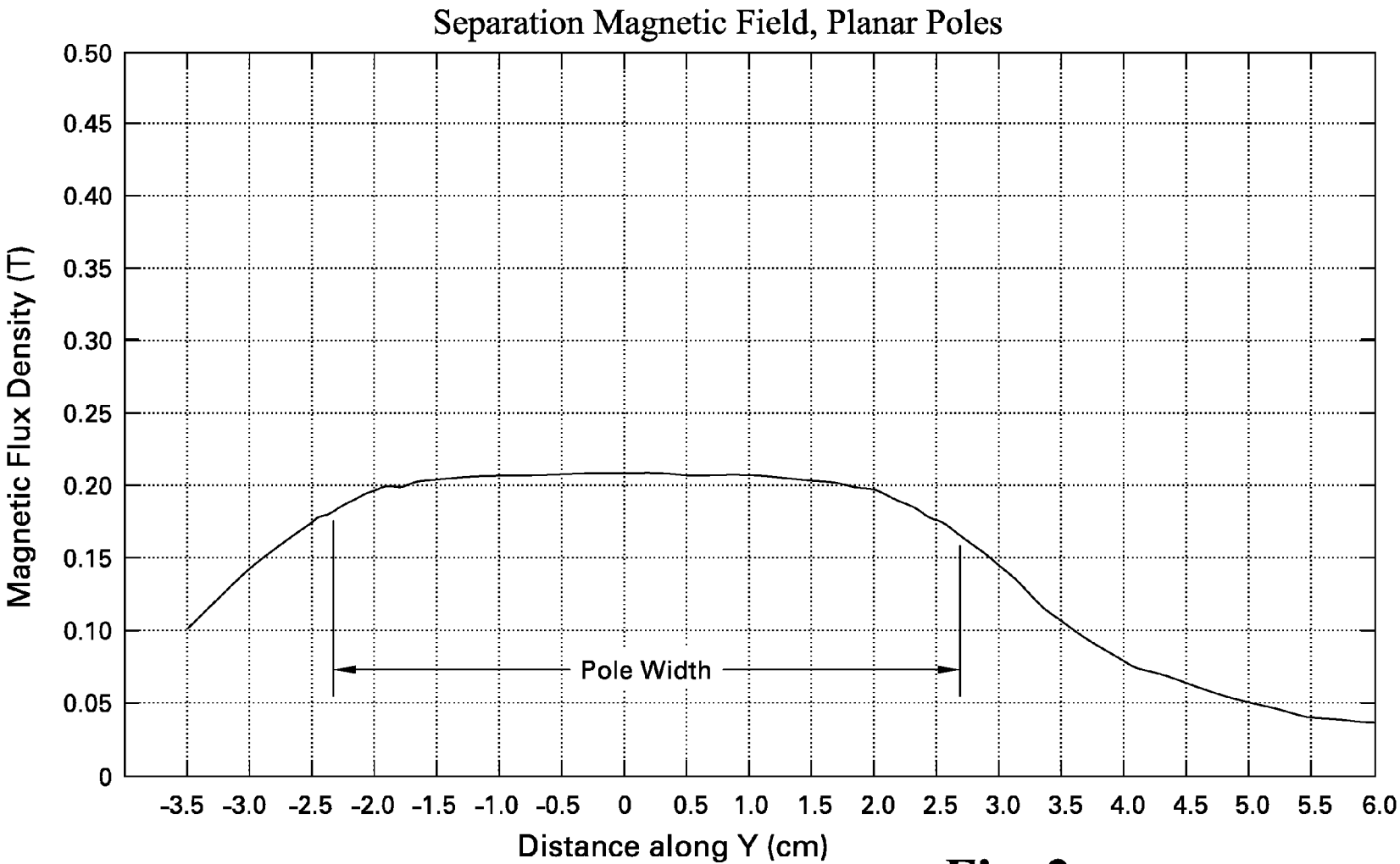
FIG. 2 is a plot of a separation magnetic field for planar poles illustrating how the magnetic flux density varies with distance both in the air gap of the poles and progressing away from the gap.
Figure 3:
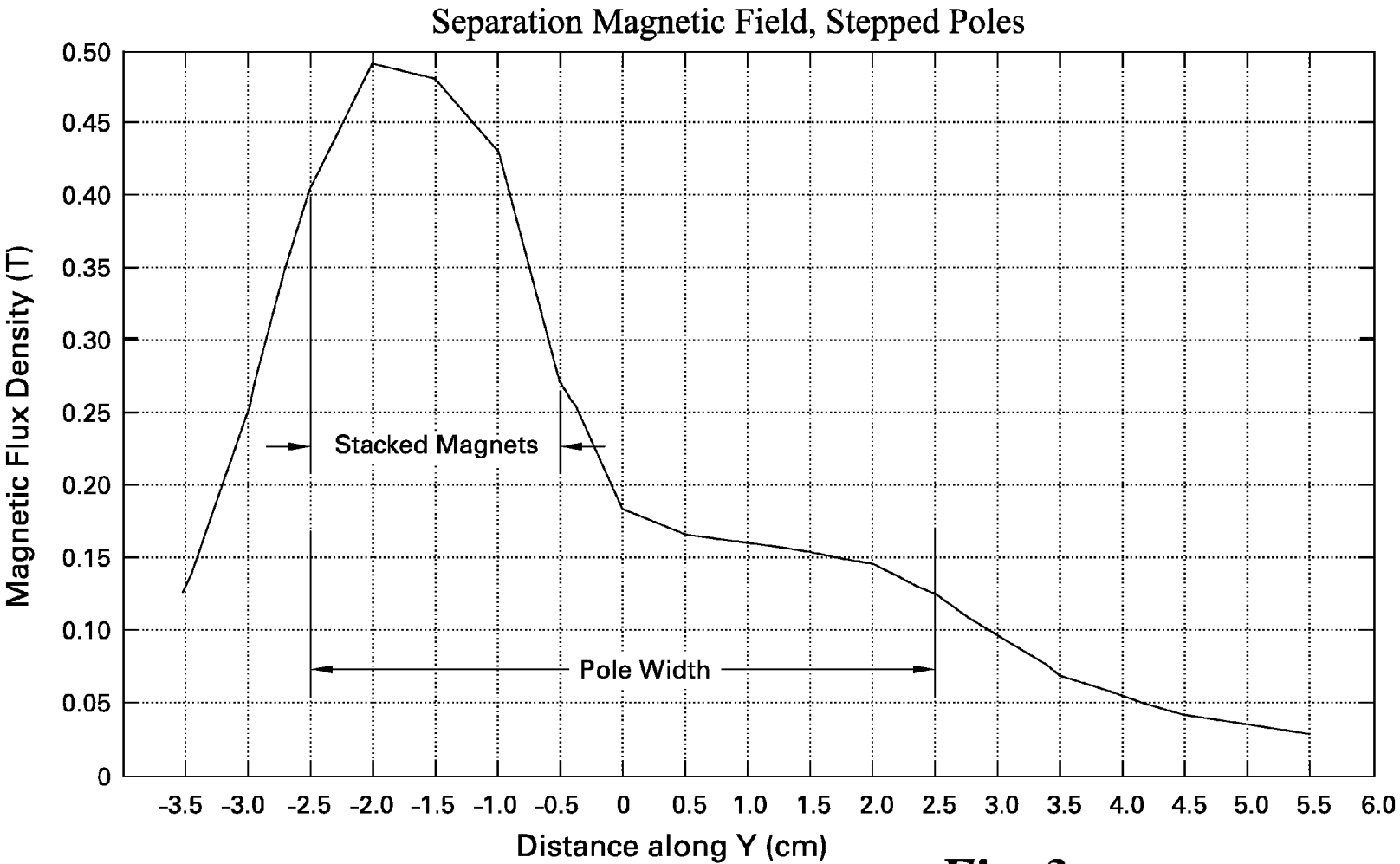
FIG. 3 is a plot of a separation magnetic field for stepped poles illustrating how the magnetic flux density varies with distance both in the air gap of the poles and progressing away from the gap.

FIGS. 2 and 3 illustrate the magnetic fields obtained from flat planar poles and a species of shaped poles, stepped poles. Each is a plot of magnetic flux density versus distance from the center of the air gap of the poles of the primary magnet. In FIG. 2 the magnetic flux density is essentially uniform in the air gap indicated by the legend "Pole Width". Thus magnetic separation can only be effectively obtained in the portion of the magnetic field that extends outside the air gap. Because the magnetic flux density falls off quickly in this region only a short width is available for separation before the field becomes too weak. In FIG. 3 the magnetic flux density from the combined effect of the primary magnet, which is the same flat planar poles magnet as in FIG. 1, and stacked magnets stacked inside the air gap of the primary magnet at the location indicated by the legend "Stacked Magnets" is the creation of a magnetic field gradient over much of the air gap of the primary magnet. Thus the width available for separation has been substantially increased. This approach can be quite helpful when more than one magnetically tagged target biological material is to be separated since it allows longer deflection distances. For instance if all the martial enters at one inlet some will need to be deflected by more than one outlet.

The magnetic field gradient needed to appropriately divert the target magnetically tagged biological material out of laminar flow depends upon the deflection distance to the assigned outlet for that material and its residence time in the separation zone of the separation chamber. The greater the deflection distance and the shorter the residence time the greater is the required field gradient. The residence time in turn depends upon the fluid velocity through the separation chamber and the length of the chamber. A magnetic field gradient of greater than about 1 T/m, preferably 5 T/m, over the deflection path is convenient. In this regard the gradient need not be uniform over the deflection path but need only be sufficient over the entire deflection path to ensure that the tagged target biological material is appropriately deflected. For a deflection distance of about 10 mm, a fluid flow of the injected target stream of about 4 ml/minute and a chamber length of about 80 mm, a magnetic field gradient of 2 T/m or greater is convenient.

The deflected magnetically responsive particles can be more precisely focused to their intended outlets through the use of high permeability strips (e.g., strip 30 in FIG. 1) located adjacent these outlets (e.g., outlet 14 in FIG. 1). It is convenient to use a material with a permeability of about 500 or greater. One approach is to use iron or nickel strips that are 1 mm wide by 20 mm long and 500 microns thick oriented with the length in the direction of laminar flow and placed directly before an outlet.

The magnetic separation process should effectively enrich the target streams in the target biological materials while depleting the original injected sample stream of these same materials. In one embodiment the stream emerging from the outlet opposite the inlet into which the sample is injected should be depleted of the magnetically tagged target biological materials while the streams emerging from the outlets to which such materials are intended to be deflected should be enriched in such materials. It is convenient if the target streams have a purity of greater than about 80%, meaning that at least about 80% of the biological material of the type which is of interest, such as cells, is the target biological material intended to appear in that stream. It is also convenient if laminar flow containing the injected sample stream has a purity as it exits the chamber of at least about 80% meaning that less than about 20% of the biological material of the type of interest is target biological material. For instance, if the type of biological material which is of interest is living cells and there are two cell types which are targets it is desirable that the cells in each the target stream consist of at least about 80% of the desired cell type and that less than about 20% of the cells in the sample stream as it exits the separation chamber be target cells. In other words it is convenient if only a rather limited amount if any of the target biological materials are lost by failure to be adequately deflected to an intended outlet. It is preferred that the purity of the target streams as so defined be at least about 90%, more preferably 95%. It is also preferred that the purity of the sample stream as it exits the separation chamber as so defined be at least about 90%, more preferably 95%.

EXAMPLE 1

A separation chamber was constructed with the dimensions of 80 mm by 40 mm by 2 mm with four inlets spaced 10 mm from each other with the outer two inlets each spaced 5 mm from a 80 mm edge of the chamber across one of the 40 mm edges and four outlets, each directly opposite an inlet, across the other 40 mm edge. Each inlet and outlet was a nozzle with a diameter of 0.75 mm.

The separation chamber was positioned in the center of the 25 mm air gap of the poles of a 50 mm by 50 mm electromagnet. The chamber was centered along its length so that the magnetic poles lay over the middle 50 mm of the chamber's 80 mm length. The width dimension of the chamber was inserted between the poles such that 15 mm of its width lay between the poles.

Current was applied to the electromagnet to generate a flux density of about 0.2 T on the surfaces (top and bottom) of the separation chamber. The magnetic flux imposed on the portion of the chamber between the poles was fairly uniform but it began to drop off rapidly upon proceeding across the width which protruded out from between the poles. The magnetic field gradient from the where the chamber began to protrude, which was essentially the centerline between the second inlet and the second outlet from the inserted edge of the chamber, to the centerline between the third inlet and the third outlet from the inserted edge of the chamber was about 7.5 T/m.

Laminar flow (a Reynolds Number less than 2000) of water was instituted between all four of the inlets and all four of the outlets with each inlet supplying at a flow rate of 2 ml/min. Then a mixture of equal amounts of magnetically responsive beads and essentially magnetically inert beads was added to the water flowing into the third inlet from the inserted edge of the chamber at a concentration of $10^5$ beads/ml. The flow rate of the water with the entrained beads as it entered the chamber was 2 ml/cm. The magnetically responsive beads were 2.8 micron Dynal M-270 polystyrene beads with imbedded Super Paramagnetic Iron Oxide (SIPO), which beads had magnetic moments between 10e-14 $A.m^2$ and 12e-14 $A.m^2$ when tested in a magnetic sweep apparatus at field strengths between 0.2 T and 0.6 T The magnetically inert beads were 3 micron Polyscience Fluoresbite YG polystyrene beads. The beads had an average residence time of about 48 seconds in the separation chamber.

A flow cytometry study was done of the beads collected at the second and third outlets. At the second outlet 97% of the magnetically responsive beads were collected while only 13% of magnetically inert beads were collected at this outlet. The beads exiting the second outlet were deflected in excess of about 5 mm in a direction normal to the laminar flow. It is hypothosized that some of the magnetically inert beads became entrained with the magnetically responsive beads as the latter moved laterally in response to the magnetic field.

Unless defined otherwise, technical and scientific terms used herein have the same meaning as is commonly understood by one of skill in the art to which this invention belongs. The terms "first", "second", and the like, as used herein do not denote any order, quantity, or importance, but rather are used to distinguish one element from another. Also, the terms "a" and "an" do not denote a limitation of quantity, but rather denote the presence of at least one of the referenced item, and the terms "front", "back", "bottom", and/or "top", unless otherwise noted, are merely used for convenience of description, and are not limited to any one position or spatial orientation. If ranges are disclosed, the endpoints of all ranges directed to the same component or property are inclusive and independently combinable (e.g., ranges of "up to about 25 wt. %, or, more specifically, about 5 wt. % to about 20 wt. %," is inclusive of the endpoints and all intermediate values of the ranges of "about 5 wt. % to about 25 wt. %," etc.). The modifier "about" used in connection with a quantity is inclusive of the stated value and has the meaning dictated by the context (e.g., includes the degree of error associated with measurement of the particular quantity).

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A process for the high throughput separation of one or more distinct biological materials from a sample containing two or more biological materials of a given type comprising;

a) tagging a target biological material with magnetically responsive particles such that said tagged target biological material will move a given minimum deflection distance in response to a given magnetic field gradient;

b) injecting said sample into an inlet of a separation chamber in which laminar flow of a fluid medium is maintained, said separation chamber having multiple outlets, one of which supports a first laminar flow path from said injection inlet to the chamber, such that a fluid flow would, in the absence of any other force, cause the biological materials in said sample entering said injection inlet to exit said outlet; and c) applying a magnetic field gradient to the separation chamber to deflect said tagged target biological material into a second laminar flow path so as to cause it to exit the separation chamber from an outlet other than the one in the first laminar flow path with the injection inlet through which it entered the chamber, wherein a material with a high relative magnetic permeability is placed adjacent each outlet of said separation chamber to which the tagged target biological material is being deflected so as to focus said tagged target biological material into said outlet, the first laminar flow path from the injection outlet is bounded on a first edge distal from the second laminar flow path by a third laminar flow path, the second laminar flow path leading to the outlet for the deflected tagged target biological material is bounded on a second edge distal from the first laminar flow path by a fourth laminar flow path, and the third and fourth laminar flow paths are not involved in separation of the tagged target biological material from the other biological materials.

2. The process of claim 1 wherein the given type of biological materials is a living cell.

3. The process of claim 1 wherein the given type of biological materials is a protein or nucleic acid.

4. The process of claim 2 wherein the target biological material is a stem cell.

5. The process of claim 1 wherein a concentration of the given type of biological materials in an injection stream is greater than about $10^7$ units/ml.

6. The process of claim 5 wherein the concentration of the given type of biological materials in the injection stream is between about $10^8$ units/ml and $10^{10}$ units/ml.

7. The process of claim 1 wherein a flow rate of an injection stream into said inlet is greater than about 1 ml/min.

8. The process of claim 7 wherein a flow rate of the injection stream into said inlet is between about 2 ml/min and 5 ml/min.

9. The process of claim 1 wherein said tagged target biological material is deflected at least about 5 mm in a direction normal to a direction of laminar flow.

10. The process of claim 9 wherein said tagged target biological material is deflected between about 10 mm and 30 mm in the direction normal to the direction of laminar flow.

11. The process of claim 1 wherein a residence time of said given type of biological materials in the separation chamber is greater than about 20 seconds.

12. The process of claim 11 wherein the residence time of said given type of biological materials in the separation chamber is between about 20 seconds and 300 seconds.

13. The process of claim 1 wherein the magnetic field gradient is applied approximately normal to a direction of laminar fluid flow in the separation chamber.

14. The process of claim 1 wherein essentially all the tagged target biological material is directed to a single outlet and the magnetic field gradient is applied such that the gradient essentially goes to zero somewhere in the second laminar flow-path into which the tagged target biological material is deflected.

15. The process of claim 1 wherein the magnetic field gradient seen by the tagged target biological material until it is in the second laminar flow path associated with the outlet intended for such material is greater than about 1 T/m.

16. The process of claim 15 wherein the magnetic field gradient is greater than about 5 T/m.

17. The process of claim 1 wherein said material with the high relative magnetic permeability has a relative magnetic permeability greater than about 500.

18. The process of claim 1 wherein;

a) there is more than one target biological material;

b) each target biological material is imparted a different magnetic responsiveness by either being tagged with a different magnetically responsive particle or being tagged with the same magnetically responsive particle in a different ratio;

c) the separation chamber is provided with a separate outlet for each tagged target biological material; and d) the magnetic field gradient is applied such that each tagged target biological material is deflected to its own outlet.

19. The process of claim 1 wherein in excess of $10^6$ units of biological materials of the given type per second are processed.

20. The process of claim 1 wherein the first, second, third, and fourth laminar flow paths flow at a same rate relative to one another.

21. A process for the high throughput separation of one or more distinct biological materials from a sample containing two or more biological materials of a given type comprising:

a) tagging a target biological material with magnetically responsive particles such that said biological material will move a given minimum deflection distance in response to a given magnetic field gradient;

b) injecting said sample into an inlet of a separation chamber which has a top surface and bottom surface which define the thickness of the chamber and in which laminar flow of a fluid medium is maintained perpendicular to this thickness, said separation chamber having multiple outlets, one of which supports a laminar flow path from said injection inlet to the chamber, such that a fluid flow would, in the absence of any other force, cause the biological materials in said sample entering said inlet to exit said outlet; and c) applying a magnetic field gradient to the separation chamber to deflect said tagged target biological material so as to cause it to exit the separation chamber from an outlet other than the one in the laminar flow path with the inlet through which it entered the chamber, wherein the magnetic field gradient is applied using a magnet whose poles are stepped or have a V or wedge shape which opens transverse to a direction of laminar flow so that its magnetic field decreases more slowly when progressing in this direction than would be the case if the poles were planar and parallel to the top and bottom of surfaces of the separation chamber thereby extending a useful magnetic field gradient further in this direction than would be the case if the poles were planar and parallel to the top and bottom of surfaces of the separation chamber thus increasing a width of the separation chamber over which separations may be affected.

22. A high throughput magnetic separation system adapted to the separation of biological materials comprising:

a) a separation chamber:

i) adapted to sustain multiple parallel laminar flows of a fluid medium along its length, with each laminar flow being maintained by an inlet in its upstream edge and an outlet opposite said inlet in its downstream edge, such that one of these laminar flows can transport a given type of biological material when it is delivered to the inlet for that laminar flow;

ii) having a first outlet and a second outlet sufficiently offset from each other to allow a magnetically tagged target biological material to be directed to the second outlet to the substantial exclusion of the first outlet by deflection from a first laminar flow associated with the first outlet to a second laminar flow associated with the second outlet, wherein the first laminar flow is bounded on a first edge distal from the second laminar flow by a third laminar flow and the second laminar flow is bounded on a second edge distal from the first laminar flow by a fourth laminar flow, and the third and fourth laminar flows are not involved in separation of the magnetically tagged target biological material from the given type of biological material; and iii) having a sufficient length in a direction of laminar flow to give the magnetically tagged target biological material an adequate residence time to be deflected from the first laminar flow to the second laminar flow upon the application of a magnetic field gradient and a material of high magnetic permeability is placed adjacent to the second outlet adapted to receive magnetically tagged target biological material so as to focus the magnetically tagged target biological material to the second outlet; and b) a source of magnetic energy adapted to apply the magnetic field gradient to said separation chamber sufficient to deflect said magnetically tagged target biological material from the first laminar flow associated with the inlet through which said magnetically tagged target biological material enters said separation chamber to the second outlet in said separation chamber associated with the second laminar flow.

23. The magnetic separation system of claim 22 wherein said material of high magnetic permeability has a relative magnetic permeability in excess of about 500.

24. The magnetic separation system of claim 22 wherein at least one of the laminar flows can transport in excess of about $10^6$ units of the given type of biological material per second.

25. The magnetic separation system of claim 22 wherein at the given type of biological material is delivered to the inlet at a concentration greater than $10^7$ units/ml.

26. A kit for the high throughput separation of biological materials comprising;

a) the magnetic separation system of claim 22; and b) magnetically responsive particles which:

i) range in size between about 10 nanometers and 1000 microns in diameter;

ii) have or develop a positive magnetic moment in the presence of a magnetic field; and iii) carry an agent or moiety on their surface adapted to specifically adhere to or bind with a particular type of biological material.

27. The kit of claim 26 wherein said particles carry an agent or moiety on their surface adapted to specifically adhere to or bind to cells which display a characteristic marker on their surface.

28. The kit of claim 27 wherein said marker is a protein.

29. The kit of claim 28 wherein said protein is a receptor.

* * * * *